United States Patent [19]

Smitley

[11] 4,269,062

[45] May 26, 1981

[54] METHOD FOR GAUGING FLUID FLOW

[75] Inventor: Marion L. Smitley, Birmingham, Mich.

[73] Assignee: Colt Industries Operating Corp., New York, N.Y.

[21] Appl. No.: 83,464

[22] Filed: Oct. 10, 1979

[51] Int. Cl.[3] ..... F02M 3/08

[52] U.S. Cl. ..... 73/118; 261/41 D

[58] Field of Search ..... 73/118; 261/41 D

[56] References Cited

U.S. PATENT DOCUMENTS

| | | | |
|---|---|---|---|
| 2,351,027 | 6/1944 | Ewart et al. | 73/118 |
| 3,456,500 | 7/1969 | Zaske | 73/118 |
| 3,469,442 | 9/1969 | Brueckner | 73/118 |
| 3,528,080 | 9/1970 | Greene et al. | 73/118 |
| 4,030,351 | 6/1977 | Smith | 73/118 |
| 4,041,777 | 8/1977 | Leunig et al. | 73/118 |

FOREIGN PATENT DOCUMENTS

| | | | |
|---|---|---|---|
| 973732 | 9/1975 | Canada | 73/118 |

*Primary Examiner*—Tim R. Miles

*Attorney, Agent, or Firm*—Walter Potoroka, Sr.

[57] ABSTRACT

A carburetor having a fuel reservoir containing fuel therein has a fuel inlet valve for controlling the admission of fuel into the reservoir, a float urges the inlet valve shut when the fuel level within the reservoir attains a preselected level, an idle fuel passage including a fluid restrictor communicates between the fuel within the reservoir and the carburetor induction passage, a conduit generally in parallel with the fuel inlet valve has one end communicating with the reservoir and an other end effective for communicating with a source of fuel, an auxiliary valve is situated in series with the fuel inlet passage upstream of the fuel inlet valve, a relatively low flow-rate valve is serially situated in the parallel conduit, and a fuel level indicator is responsive to the actual level of the fuel in the reservoir, the auxiliary valve is opened to fill the reservoir through the fuel inlet valve to a preselected level and have the float shut the inlet valve after which the auxiliary valve is closed, and then the low flow-rate valve supplies fuel to the reservoir at a rate of flow equal to the specified rate of flow to be discharged to the engine and the flow area of the fluid restrictor is adjusted so that the elevational level of the fuel in the reservoir is constant indicating that the flow discharge from the carburetor is exactly the same as the flow rate of fuel entering the carburetor.

10 Claims, 1 Drawing Figure

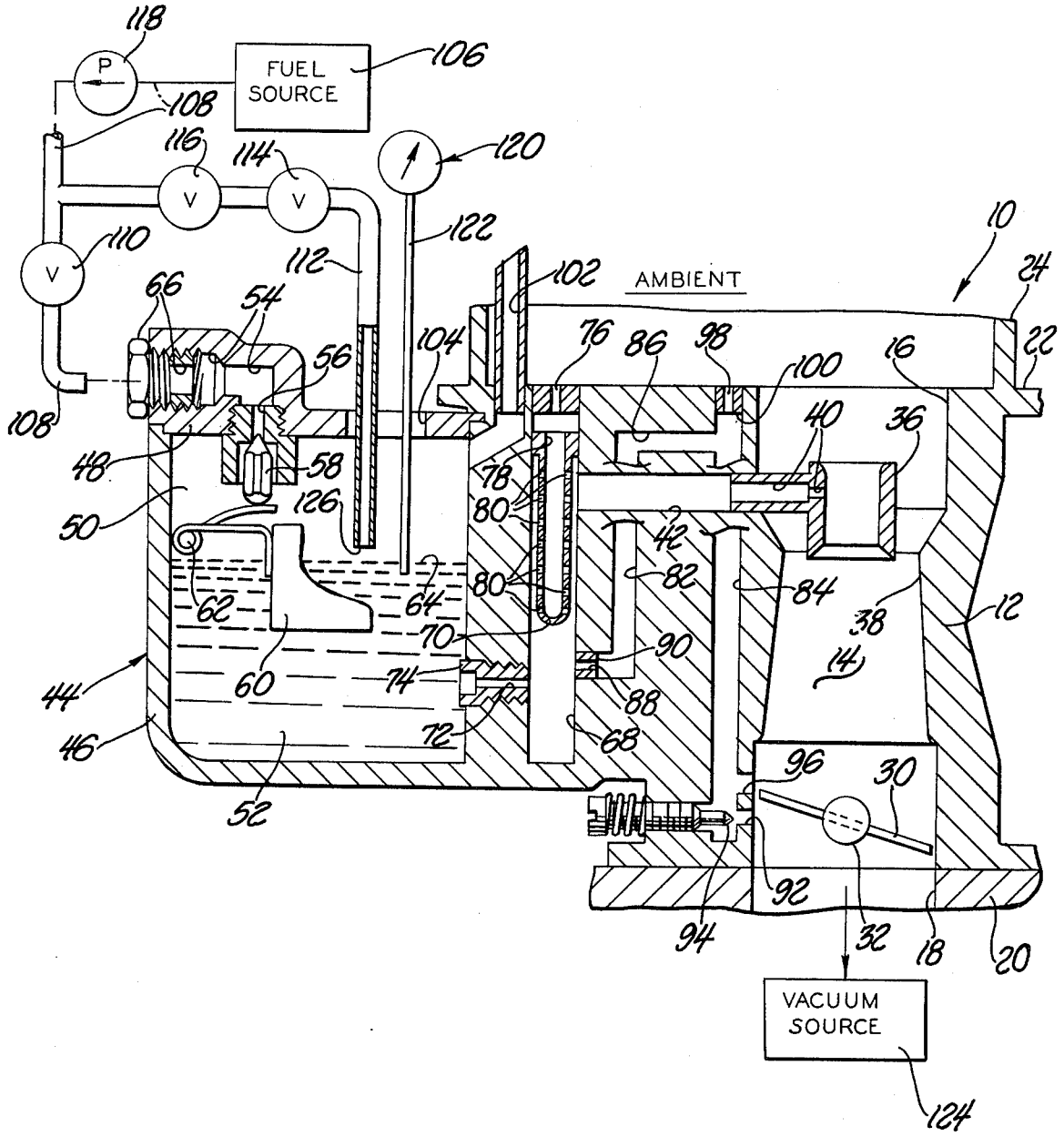
FUEL SOURCE
AMBIENT
VACUUM SOURCE
P
V
V
V
118
106
108
116
114
120
122
110
112
102
10
24
66
54
104
76
86
98
100
16
22
56
108
40
36
48
58
78
50
126
80
42
82
84
62
64
80
38
12
70
90
14
44
60
74
88
46
72
68
96
30
52
92
94
32
18
20
124

METHOD FOR GAUGING FLUID FLOW

Because of a general concern for the elimination and/or reduction of atmospheric pollutents and because of unilaterally determined governmentally imposed regulations relating to engine exhaust emissions and fuel consumption, carburetors have to meet performance specifications, with regard to fuel-air ratios, of exceedingly close tolerances. In order to be assured that each carburetor, for example, sold by a carburetor manufacturer, meets such specifications, the prior art has found it necessary to actually test such carburetors under simulated engine operating conditions to see if the fuel-air ratio produced by such carburetor meets the related performance specifications.

This has been done for many years by using a production test stand where a specified and exact amount of air flow is induced through the carburetor and flow of fuel going into the inlet of the carburetor is accurately measured. This system is the prior art accepted method of flowing carburetors. However, with the advent of smaller cars and engines, the rate of fuel flow, at idle, becomes very small. Since the prior art test system measures the fuel flow going into the carburetor rather than what is discharged to the engine, and since such flow is dependent upon the responsiveness of the carburetor fuel inlet system (fuel bowl float, inlet needle valve, inlet valve seat, fuel pressure, etc.) it can be seen that the fuel flow as measured at the inlet to the carburetor may vary or be erratic. Further, since the fuel flow being discharged to the engine is for all practical purposes independent of the height of the fuel level in the fuel bowl at idle (the metering forces at idle being engine manifold vacuum which creates a very high metering pressure differential as compared to a fractional inch of pressure head created by differing elevations of fuel in the fuel bowl), the fuel being discharged to the engine, by practicing the invention, can accurately be determined by supplying the precise amount of fuel into the fuel bowl as through a low flow rate metering valve and adjusting the idle fuel discharge valve to obtain a fixed or constant fuel level in the fuel bowl. By so doing, in practicing the invention, if the fuel level in the fuel bowl increases, the idle fuel discharge valve is adjusted to be further opened to thereby allow more fuel to be discharged to the engine. If, on the other hand, the level of the fuel in the fuel bowl decreases, the idle fuel discharge valve is adjusted to be further closed to thereby allow less fuel to be discharged to the engine.

Accordingly, the invention as herein disclosed is primarily directed to the solution of the prior art problems as well as other related and attendant problems.

SUMMARY OF THE INVENTION

According to the invention, a fuel metering device, such as a carburetor having a fuel reservoir chamber containing fuel therein, has a fuel inlet passage leading to the reservoir chamber with a fuel inlet valve for controlling the admission of such fuel through the passage and into the reservoir chamber, a float operatively engages the inlet valve and urges the inlet valve shut when the level of the fuel within the reservoir chamber attains a preselected elevational level, engine idle fuel passage means including fluid restriction means therein communicates between the fuel within the reservoir chamber and the induction passage of the carburetor, a conduit is placed generally in parallel with the fuel inlet valve as to have one end communicating with the reservoir chamber and an other end effective for communicating with a source of fuel which may be common with the fuel inlet passage, a first auxiliary valve is situated in series with the fuel inlet passage and upstream of the fuel inlet valve, a relatively low flow-rate valve is serially situated in the parallel conduit and a second auxiliary valve is also serially situated in the parallel conduit upstream of the relatively low flow-rate valve, and a fuel or liquid level indicating device is placed as to be responsive to the actual elevational level of the fuel in the reservoir chamber, the first auxiliary valve is opened to thereby permit the fuel reservoir to become filed to a preselected elevational level and thereby have the float close-off the related fuel inlet valve, the first auxiliary valve is then closed and the second auxiliary valve is opened thereby permitting a preselected volume rate of fuel to flow through the relatively low flow-rate valve and into the fuel reservoir chamber with such preselected volume rate being equal to the rate of fuel flow to be discharged through the idle fuel system and into the engine induction passage means, establishing a rate of air flow through the induction passage of the carburetor as to have such rate equal to the rate of air flow to be supplied to the engine to be associated with such carburetor at idle condition, observing the liquid level indicating device to see if the elevational level of the fuel in the fuel reservoir chamber is remaining at the preselected elevational level or if the elevational level of the fuel is decreasing or increasing, if the elevational level of the fuel is observed to be decreasing then varying the restrictive quality of the idle fuel discharge restrictor until the effective restriction thereof is such as to stop further decreasing of said elevational level and if the elevational level of the fuel is observed to be increasing then varying the restrictive quality of the idle fuel discharge restrictor until the effective restriction thereof is such as to stop further increasing of said elevational level, and, if the elevational level is observed to be remaining at said preselected or original elevational level not varying the restrictive qualities of said idle fuel discharge restrictor.

Various general and specific objects, advantages and aspects of the invention will become apparent when reference is made to the following detailed description considered in conjunction with the accompanying drawings.

BRIEF DESCRIPTION OF THE DRAWING

The single drawing, wherein for purposes of clarity certain details and/or elements may be omitted, is a generally cross-sectional view taken as through a vertically extending induction passage of a carburetor with apparatus associated therewith and embodying teachings of the invention.

DETAILED DESCRIPTION OF THE PREFERRED EMBODIMENT

Referring now in greater detail to the drawing, a fuel metering device, such as a carburetor 10, is depicted as comprising a body 12 with an induction passage 14 formed therethrough and communicating, at its upper end, with an air inlet portion 16 and, at its lower end, as with a conduit portion 18 of related apparatus or fixture means 20. The upper portion of carburetor body means 12 may be provided with a suitable annular flange 22 for receiving, thereon, a cooperating air cleaner assembly (not shown but well known in the art). Suitable generally upwardly extending wall means, a portion of which is shown at 24, may be provided and such, as is also well known in the art, may serve to support related choke valve means (not shown). A throttle valve 30 is situated generally in the lower end of the induction passage 14 and carried as by a transversely extending throttle shaft 32 suitably journalled within body means 12 and operatively connected to associated throttle actuating linkage means (not shown but well known in the art).

A main fuel discharge nozzle 36 is positioned generally within the throat of induction passage main venturi section 38 and has a conduit portion 40 thereof communicating with a conduit 42 formed in body means 12.

A fuel reservoir assembly or section 44 is illustrated as comprising a housing portion 46 defining, in cooperation with suitable cover means 48, a fuel reservoir chamber 50 for the containment of fuel 52 therein. A fuel inlet passage 54 communicates with a valve orifice or valve passage 56 which is controlled by an openable and closable fuel inlet valve 58 which, in turn, is positioned by a float 60 pivotally supported as by pivot support means 62. As is well known, when the elevational level of the fuel 52 within bowl or reservoir chamber 50 attains a preselected elevational level, as depicted at 64, float 60 will have moved upwardly sufficiently to close inlet valve 58 against its seat to thereby terminate fuel flow through valve passage 56 and into reservoir chamber 50. Suitable conduit fitting means 66 may be operatively connected to inlet passage means 54.

A main fuel well 68, communicating with conduit 42, contains a main well tube 70 and communicates generally at its lower end with the fuel 52 within fuel bowl chamber 50 as through the calibrated passage 72 of restriction means 74. The upper end of main well 68 is placed in communication with a source of ambient air or pressure as via a calibrated main air bleed or restriction 76 which may be vented to the interior of the general chamber communicating with the air inlet portion 16. As is well known in the art, the function of the main well tube 70, which has an axial passageway 78 and a plurality of radial apertures or passages 80 communicating between the inner passageway 78 and the interior of main well 68, is to provide a controlled rate of bleed air to be mixed with the fuel flowing upwardly through the main well 68 and out through conduit portions 42 and 40 thereby reducing the weight of the fuel in order to make it more responsive to the variations of venturi vacuum developed at the throat of venturi section 38. Further, as is well known in the art, the main nozzle 36 does not supply a metered rate of fuel flow to the induction passage 14 until the engine speed and load are sufficiently great to cause a volume rate of air flow through the venturi section 38 in excess of a predetermined minimum volume rate of such air flow.

Accordingly, for engine operating conditions wherein the actual volume rate of air flow through the venturi section 38 is less than such a predetermined rate, an idle fuel metering system is provided in order to supply a metered rate of idle fuel flow to the induction passage 14. As is well known in the art, the idle fuel system functions to meter idle fuel flow to the induction passage and engine in accordance with the magnitude of the manifold, or engine vacuum, developed by the engine within the intake manifold which, for the purposes of this disclosure, may be considered equivalent to apparatus 20.

As depicted, the idle fuel system may be comprised of an idle well 82 having its upper end in communication with a generally vertically disposed conduit 84 as by means of a horizontal conduit portion 86. The lower end of idle well 82 communicates with the main well 68 as through a calibrated passage 88 formed in an idle fuel metering restriction 90. The lower end of conduit 84 communicates with the induction passage 14 as by an idle fuel discharge port 92 the effective area of which can be adjustably determined as by a threadably adjustable idle fuel needle valve 94. Generally, such needle valve 94 and cooperating port 92 may be considered as collectively defining or comprising idle fuel discharge restrictor means. As indicated, the port 92 is intended to discharge metered idle fuel into the induction passage 14 at a point generally downstream of the throttle valve 30 when the throttle valve 30 is in its nominally closed or curb-idle position.

The lower end of conduit 84 may also be in communication with a second discharge port or slot 96 which is so located as to be somewhat above port 92. The purpose of the second port 96, often referred to as a transfer slot or port, is to provide a fuel flow therethrough whenever the throttle valve 30 has been sufficiently rotated in the throttle opening direction (clockwise as viewed in the drawing) so as to expose the port 96 (or any portion thereof) to the relatively low pressure generally below or posterior to the throttle valve 30. The intention behind providing such a transfer slot or port 96 is to provide a smooth transition from the idle fuel system to the main fuel system.

As depicted, the upper end of conduit 84 is placed in controlled communication with the ambient as by a calibrated passage 98 of an idle air bleed restriction 100. Air bleed restriction and passage 98 perform a function similar to that of main air bleed restriction 76 in that such restriction 100 serves to supply a controlled rate of bleed air flow into conduit 84 or 86 so as to have such bleed air mix with the idle fuel being supplied by the idle fuel well 82 in order to make such mixture lighter and more responsive to sensed variations in the magnitude of the engine intake manifold or low pressure posterior to throttle valve 30. Air bleed restriction means 100 may, of course, be vented to the general area of the air inlet portion 16.

As is usually the case, a vent tube and conduit means 102 may be provided as to communicate ambient pressure to the interior of chamber 50 thereby causing the fuel to experience a metering pressure differential, during idle engine operation, determined by the difference between such ambient and the pressure to which port 92 is exposed.

The cover 48 is shown as having a clearance opening or passageway 104 provided therethrough which passageway is closed by any suitable closure means upon the carburetor 10 being tested and made ready for installation onto an associated engine.

A suitable source of fuel is shown at 106 with conduit means 108 leading from there to the fuel inlet passage means 54 with such conduit means 108 being possibly connected to or through the fitting means 66. Conduit means 108 is provided with serially situated valve means 110. Second conduit means 112, which may be considered as being generally in parallel with that portion of conduit 108 containing valve 110, communicates at one end with the source of fuel 106, as through a portion of conduit means 108, and, at its other end, communicates with the interior or chamber 50 of fuel reservoir means 44. As shown, conduit means 112 is depicted as passing through opening or access means 104.

Conduit means 112 is shown as having, in series therewith, first flow valve means 114 and second valve means 116 situated upstream of flow valve means 114. Flow valve means 114 may be of any suitable type or construction which will provide for accurately establishing and maintaining a relatively small selected volume rate of fuel flow therethrough as, for example, a rate of fuel flow anywhere in the range of, for example, 1.5 to 4.0 pounds of gasoline per hour. (Presently, the rate of 1.5 to 4.0 pounds of gasoline per hour is the usual range and rate of gasoline flow to and consumed by the relatively small to medium sized vehicular engines at curb idle engine operation.) Valves 110 and 116 may each be of any particular type or configuration as to be, at times, respectively capable of shutting-off fuel flow therethrough. As also depicted suitable pump means may be provided in conduit means 108 as at 118. Further, suitable liquid level responsive gauging, read-out or indicating means 120 is shown as having such liquid level sensing portion 122 passing through access means 104 and into operative or functional engagement with the fuel 52 and the elevational level 64 thereof.

OPERATION OF INVENTION

In the preferred form of the invention, the carburetor 10 is suitably secured to apparatus 20 in the manner generally depicted placing induction passage means 14 in communication with conduit or passage 18. As shown, conduit 18 is in communication as with suitable pumping means or the like forming what may be referred to as a low pressure or vacuum source 124 capable of providing preselected volume rates of air flow through the induction passage means 14 and passage means 18.

According to the invention, the throttle valve 30 is placed in the normal curb idle position, as depicted in the drawing, and air-pumping or vacuum source is energized as to establish a volume rate of air flow past throttle 30 corresponding to a predetermined volume rate of air flow which is equivalent to that volume rate of air flow which has been previously determined (as by the engine manufacturer) necessary to maintain the engine (on which such carburetor is intended to be employed) at normal curb idle operation.

With valve 116 being closed, valve 110 is opened thereby permitting a relatively large volume rate of fuel flow to flow from fuel source 106, through conduit 108, valve 110, inlet passage means 54, valve passage 56 and past the open valve 58 into the fuel bowl or reservoir chamber 50. Such fuel flow past inlet valve 58 continues until the fuel 52 within chamber 50 attains a preselected elevational level, as depicted at 64, at which time the float 60 will have moved upwardly sufficiently to move inlet valve 58 closed as to terminate further flow through cooperating passage or conduit 56. At that time valve 110 is closed.

With the fuel having attained such a preselected elevational level, the related level sensing means 120, of course, establishes, in effect, a "zero" or reference reading or value (which may be, in effect, a related output to other associated instrumentation).

Valve 116 is then opened thereby enabling fuel to flow from source 106, through conduit 108, conduit 112, valve 116, valve 114 and, out of end 126 of conduit 112, into fuel reservoir chamber 50. It should be pointed out that having established the desired rate of air flow past throttle valve 30, the air pumping or vacuum source 124 may be de-activated during the time that bowl chamber 50 is being filled, as hereinbefore described, through valve 110 and inlet valve 58. In any event, with the rate of air flow now passing through the induction passage 14 and past throttle valve 30, with a reference or "zero" reading having been established by sensing means 120, and with the fuel now flowing through valve 114, the proper adjustment of the idle fuel discharge restrictor means 92, 94 can be accomplished.

More specifically, let it be assumed that engine specifications (for the engine on which the carburetor is intended to be employed) require that at normal curb idle air flow the carburetor idle fuel discharge restrictor meter or discharge fuel into the induction passage 14 at a rate of 1.5 pounds of fuel per hour. The valve 114 would, therefore, be either calibrated or adjusted as to provide only such a required rate of fuel flow, namely, 1.5 pounds per hour. With such assumed conditions (for purposes of disclosure) it can be seen that: (a) the preselected rate of air flow through induction passage means 14 and throttle 30 is established and maintained by air pumping or vacuum source means 124 and (b) the corresponding required and prescribed rate of idle fuel flow is being supplied to the fuel chamber 50 via valve 114 and conduit 112. The only variable existing in the system is the rate of flow which is occurring as from fuel chamber 50, through passage 72, well 68, passage 88, well 82, conduits 86, 84 and through the idle fuel discharge orifice 92.

By now it should be apparent that if, with the prescribed rate of idle fuel flow being supplied through valve 114, the elevational level sensing means 120 remains at the established "zero" reference value, the rate of idle fuel being discharged by the idle fuel discharge restrictor means 92, 94 into the induction passage means 14 is exactly the same rate as that being supplied to the carburetor via valve means 114 and, therefore, proper. This, in turn, means that no adjustment of the needle valve 94 relative to orifice 92 is needed.

However, if it is assumed that with the prescribed rate of idle fuel flow being provided via valving means 114, the elevational level sensing means 120 indicates that the actual elevational level of the fuel 52 is rising from that of the preselected level 64, then, obviously, the actual rate of idle fuel being discharged into the induction passage means 14 by the idle fuel discharged restrictor means 92, 94 is less than the prescribed rate of idle fuel. Accordingly, in order to correct this, the idle fuel needle valve 94 is adjusted as to increase the effective flow area as between itself and discharge orifice 92. Such adjustment continues until the elevational level sensing means 120 indicates that the actual elevational level is no longer rising, and, of course, not decreasing thusly assuring that the desired and proper metering rate of idle fuel has been attained.

Further, if it is assumed that with the prescribed rate of idle fuel flow being provided via valving means 114, the elevational level sensing means 120 indicates that the actual elevational level of the fuel 52 is decreasing from that of the preselected level 64, then, obviously, the actual rate of idle fuel being discharged into the induction passage means 114 by the idle fuel discharge restrictor means 92, 94 is greater than the prescribed rate of idle fuel. Accordingly, in order to correct this, the idle fuel needle valve 94 is adjusted as to decrease the effective flow area as between itself and discharge orifice 92. Such adjustment continues until the elevational level sensing means 120 indicates that the actual elevational level is no longer decreasing, and, of course, not increasing.

Accordingly, it can be seen that the invention provides an easy and very accurate method by which metered fuel flow through a fuel metering device can be determined and established as to meet any particular engine specifications and that any errors, which would have arisen with prior art system, are eliminated.

It should be mentioned that the term "fuel" as used herein and in the claims is intended to mean either actual fuel or a liquid which is fuel-like in that its physical characteristics much like or equivalent to the actual fuel to be metered by the carburetor during actual use of the carburetor on an engine.

Although only a preferred embodiment of the invention has been disclosed and described, it is apparent that other embodiments and modifications of the invention are possible within the scope of the appended claims.

What is claimed is:

1. A method for establishing a preselected rate of fuel flow through the idle fuel metering system of a carburetor having a fuel reservoir, idle fuel discharge conduit means, and idle fuel discharge restrictor means wherein said restrictor means comprises an adjustable valve member and cooperating valve orifice, said method comprising the steps of supplying fuel to said fuel reservoir at a rate of flow equal to said preselected rate of fuel flow, and adjusting said adjustable valve member relative to said valve orifice in response to sensed variations of the fuel level in said reservoir so as to have the rate of flow of fuel passing through said idle fuel discharge conduit means and said restrictor means equal to the rate of fuel being supplied to said fuel reservoir.

2. In a combustion engine carburetor having a fuel reservoir for containing a supply of fuel therein, induction passage means with throttle valve means for controlling the rate of air flow through said induction passage means and to said engine, fuel conduit means having one end effective for communication with said fuel in said fuel reservoir and an other end effective for discharging fuel to said engine, and fuel discharge restrictor means in said fuel conduit means for restricting the flow of said fuel being discharged to said engine, the method for establishing a preselected rate of flow of said fuel being discharged to said engine through said fuel conduit means, said method comprising the steps of establishing a preselected rate of air flow through said induction passage means past said throttle valve means, establishing a preselected elevational level of said fuel within said fuel reservoir, supplying fuel to said fuel reservoir at a rate of flow equal to said preselected rate of fuel flow, determining whether said preselected elevational level of said fuel remains constant as said fuel to said fuel reservoir is being supplied at said rate of flow equal to said preselected rate of fuel flow, and if said elevational level of said fuel is determined to be varying from said preselected elevational level as said fuel to said fuel reservoir is being supplied at said rate of flow equal to said preselected rate of fuel flow then altering the effective flow area of said restrictor means as to thereby result in said elevational level becoming stabilized thereby simultaneously resulting in the rate of fuel being discharged through said restrictor means and said fuel conduit means being equal to the rate of flow of said fuel being supplied to said fuel reservoir.

3. A method according to claim 1 wherein the step of stabilizing said elevational level comprises the step of causing said elevational level to attain said preselected elevational level when stabilized.

4. A method according to claim 1 wherein said fuel discharge restrictor means comprises an adjustable needle valve and cooperating valve orifice, and wherein the step of altering the effective flow area of said restrictor means comprises the step of adjusting said needle valve relative to said valve orifice.

5. A method according to claim 1 wherein the step of altering the effective flow area comprises the step of increasing the effective flow area of said restrictor means.

6. A method according to claim 5 wherein said fuel discharge restrictor means comprises an adjustable needle valve and cooperating valve orifice, and wherein the step of increasing the effective flow area of said restrictor means comprises the step of adjustably moving said needle valve away from said valve orifice.

7. A method according to claim 1 wherein the step of altering the effective flow area comprises the step of decreasing the effective flow area of said restrictor means.

8. A method according to claim 7 wherein said fuel discharge restrictor means comprises an adjustable needle valve and cooperating valve orifice, and wherein the step of decreasing the effective flow area of said restrictor means comprises the step of adjustably moving said needle valve toward said valve orifice.

9. A method according to claim 1 wherein said other end of said fuel conduit means discharges said fuel to said engine by discharging said fuel into said induction passage means of said carburetor.

10. A method according to claim 9 wherein said fuel is discharged into said induction passage means at a point downstream of said throttle valve means.

* * * * *